US008479361B2

(12) United States Patent
Every

(10) Patent No.: US 8,479,361 B2
(45) Date of Patent: Jul. 9, 2013

(54) FLEXIBLE STRAP FASTENER

(75) Inventor: Joseph J. Every, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 319 days.

(21) Appl. No.: 12/619,134

(22) Filed: Nov. 16, 2009

(65) Prior Publication Data

US 2010/0146742 A1 Jun. 17, 2010

Related U.S. Application Data

(60) Provisional application No. 61/138,234, filed on Dec. 17, 2008.

(51) Int. Cl.
*B65D 63/10* (2006.01)

(52) U.S. Cl.
USPC ..... 24/16 PB; 24/17 AP

(58) Field of Classification Search
USPC ..... 24/16 PB, 16 R, 30.5 P, 17 AP, 298, 24/300, 306
See application file for complete search history.

(56) References Cited

U.S. PATENT DOCUMENTS

| | | | | |
|---|---|---|---|---|
| 3,102,311 | A * | 9/1963 | Martin et al. | 24/16 PB |
| 3,731,348 | A | 5/1973 | Luehne | |
| 3,991,444 | A * | 11/1976 | Bailey | 24/16 PB |
| 4,001,898 | A * | 1/1977 | Caveney | 24/16 PB |
| 4,730,615 | A | 3/1988 | Sutherland et al. | |
| 4,875,647 | A | 10/1989 | Takagi et al. | |
| 5,031,943 | A * | 7/1991 | Scott et al. | 292/307 R |
| 5,103,534 | A | 4/1992 | Caveney | |
| 5,146,654 | A * | 9/1992 | Caveney et al. | 24/16 PB |
| 5,193,254 | A * | 3/1993 | Geisinger | 24/484 |
| 5,389,330 | A * | 2/1995 | Sorensen et al. | 264/328.1 |
| 5,398,383 | A * | 3/1995 | Bingold | 24/16 PB |
| 5,414,904 | A * | 5/1995 | Sampson | 24/16 PB |
| 5,630,252 | A | 5/1997 | Wells | |
| 5,675,870 | A * | 10/1997 | Cooper | 24/16 PB |
| 5,803,413 | A * | 9/1998 | Benoit et al. | 248/73 |
| 5,911,368 | A * | 6/1999 | Davignon | 24/16 PB |
| 5,924,171 | A * | 7/1999 | Sorensen et al. | 24/16 PB |
| 6,138,327 | A * | 10/2000 | Powell et al. | 24/16 PB |
| 6,256,847 | B1 | 7/2001 | Manley et al. | |
| 6,863,855 | B2 | 3/2005 | Shilale | |
| 7,201,352 | B2 | 4/2007 | Kawai | |
| 2005/0050691 | A1 | 3/2005 | Schroder et al. | |
| 2006/0162130 | A1 | 7/2006 | Cook | |
| 2010/0236030 | A1 * | 9/2010 | Dyer | 24/16 PB |

FOREIGN PATENT DOCUMENTS

GB 1479605 A * 7/1977

OTHER PUBLICATIONS

U.S. Appl. No. 11/041,234 to Cook filed Jan. 25, 2005, Office Action mailed Nov. 4, 2005, Response mailed Feb. 3, 2006, Final Rejection mailed Feb. 27, 2006.

* cited by examiner

*Primary Examiner* — Robert J Sandy
*Assistant Examiner* — Louis Mercado
(74) *Attorney, Agent, or Firm* — Miller, Matthias & Hull

(57) ABSTRACT

A flexible strap fastener includes a head portion having a passage and a locking pawl disposed within the passage. The flexible strap fastener further includes a strap portion connected to the head portion. The strap portion includes a first surface and a plurality of locking ridges disposed on the first surface. Additionally, cushioning material is disposed adjacent the plurality of locking ridges on the first surface.

17 Claims, 2 Drawing Sheets

FLEXIBLE STRAP FASTENER

CROSS-REFERENCED TO RELATED APPLICATIONS

This application claims benefit of U.S. Provisional Application No. 61/138,234 filed Dec. 17, 2008.

TECHNICAL FIELD

This disclosure relates to flexible strap fasteners and more particularly to such fasteners with enhanced fixation of one or more secured articles.

BACKGROUND

Flexible strap fasteners, commonly referred to as cable ties, are widely used to secure articles, such as electrical cables, and hydraulic hoses that extend between machine components. Such ties may also be used to secure bundled elements or an individual component to associated equipment or a frame.

Flexible strap fasteners are usually formed from a moldable plastic or stamped metal. They commonly include an elongate strap provided with locking serrations or ridges on one surface and an integral locking head disposed at one end. The integral locking head defines a passage that permits insertion of the strap through the passage. The locking head also includes a locking pawl disposed to engage the locking serrations or ridges of the strap to prevent withdrawal of the strap from the passage of the locking head. For example, a cable tie is disclosed in U.S. Patent Application Publication No. 2006/0162130. The '130 cable tie includes a plurality of engaging members on a first surface, a cushioning layer on an opposite second surface, and a fastener head.

SUMMARY OF THE INVENTION

In one example of the present invention, a flexible strap fastener is provided. The flexible strap fastener includes a head portion having a passage and a locking pawl disposed within the passage. The flexible strap fastener further includes a strap portion connected to the head portion. The strap portion includes a first surface and a plurality of locking ridges disposed on the first surface. Additionally, cushioning material is disposed adjacent the plurality of locking ridges on the first surface.

DETAILED DESCRIPTION

Figure 1:
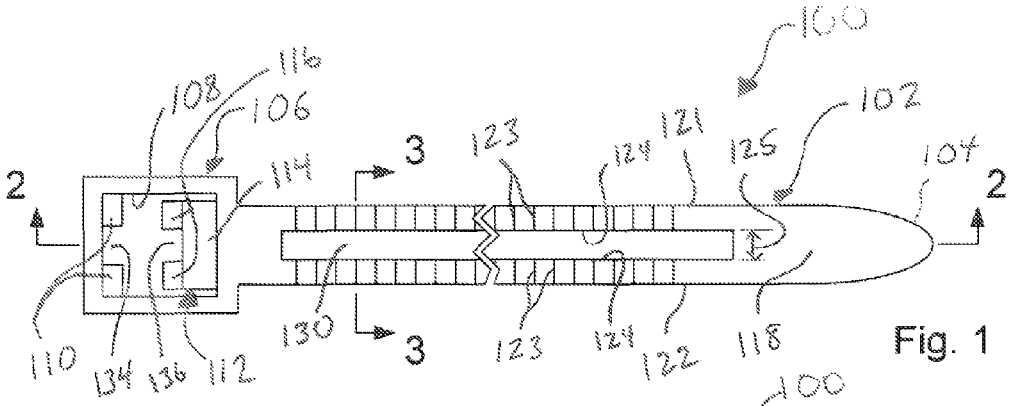
FIG. 1 is a top elevation view of a flexible strap fastener.
Figure 2:
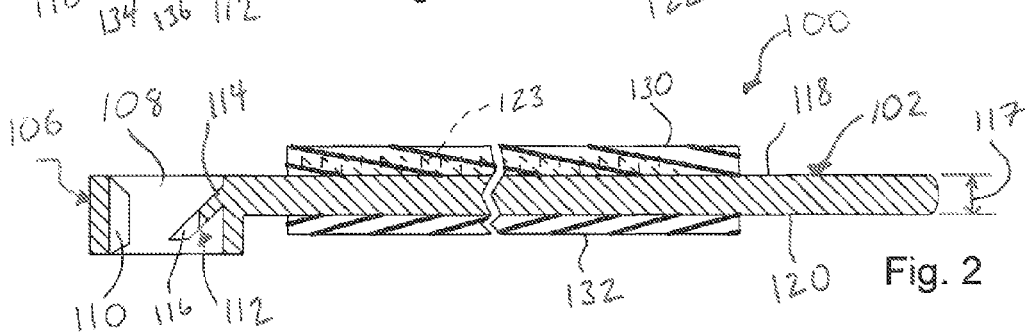
FIG. 2 is a cross sectional view of the flexible strap fastener along line 2-2 of FIG. 1.
Figure 3:
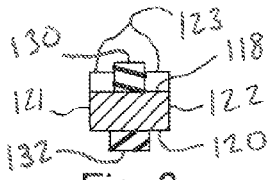
FIG. 3 is a cross sectional view of the flexible strap fastener along line 3-3 of FIG. 1.

As illustrated in FIGS. 1-3, a flexible strap fastener 100 includes a strap portion 102 having a free end 104 and a head portion 106. Head portion 106 may be separately or unitarily formed with the strap portion 102. The strap portion 102 and head portion 106 may be made of plastic or metal. For example, suitable materials may include, but are not limited to, nylon, polyethylene, polypropylene, polyetheretherketone, aluminum, stainless steel, ferritic alloys, and composite materials composed of a matrix and reinforcements.

Head portion 106 defines a passage 108 having protrusions 110. The passage 108 is sized to receive and permit passage of the strap portion 102. A locking pawl 112 is located within the passage 108 of head portion 106. As illustrated, locking pawl 112 may be a compliant mechanism with a resilient live hinge portion 114 integrally molded with strap portion 102. Optionally, locking pawl 112 may be separately formed and attached to the head portion 106. In one configuration, retention portions 116 of the locking pawl 112 may be spaced from the protrusions 110 of the passage 108 a distance less than the thickness 117 of strap portion 102 when the live hinge portion 114 is in a free or unflexed state.

The strap portion 102 may include a first surface 118 and a second surface 120 that extend between side surfaces 121 and 122. Longitudinal rows of locking ridges 123 extend transversely of the first surface 118 and outward above the first surface 118. The rows of locking ridges 123 are positioned to define a gap 125 extending between inner edges 124. Locking ridges 123 are sized and configured to engage with the retention portions 116 of the locking pawl 112 when the strap portion 102 is disposed within the passage 108.

The flexible strap fastener 100 includes cushioning material 130 disposed upon first surface 118 within gap 125 and disposed adjacent the rows of locking ridges 123 from inner edge 124 to inner edge 124 of the rows of locking ridges 123. The cushioning material 130 may extend longer than and parallel to the plurality of locking ridges 123. Further, the cushioning material 130 may project to a height above the rows of locking ridges 123 of strap portion 102 to ensure engagement between the cushioning material 130 and a secured article (not shown).

Like the cushioning material 130 disposed on the first surface 118, cushioning material 132 may optionally be disposed on the second surface 120. In the configuration shown in FIGS. 1-3, one of the cushioning materials 130 and 132 may be used to cushion and grip an article (not shown). The other of the cushioning materials 130 and 132 may assist in maintaining the flexible strap fastener 100 in position while providing additional cushioning to the article. Assistance in maintaining the flexible strap fastener 100 in position may be obtained in configurations where the other of the cushioning materials 130 and 132 of flexible strap fastener 100 has a higher coefficient of friction than the strap portion 102 and head portion 106.

The cushioning materials 130 and 132 may be made of an elastomer such as, but not limited to, silicone ethylene, natural rubber, nitrile butadiene rubber, thermoplastic olefin elastomers, polyurethane elastomers, fluoroelastomers, and other elastomers known in the art. For example, in one configuration, the cushioning materials 130 and 132 may be made of the material sold under the brand Versaflex[1] available from GLS Corporation, of McHenry, Ill. Additionally, the cushioning material 130 is softer than the material of the strap portion 102 and head portion 106. Optionally in some configurations, may have a higher coefficient of friction than the material of the strap portion 102 and head portion 106. Consequently, the cushioning material 130 has a durometer lower than the material of strap portion 102 and head portion 106.

[1] Versaflex is a trademark of GLS corporation.

In one configuration, the cushioning material 130 may be molded onto the strap portion 102. Alternatively, the cushioning material 130 may be chemically bonded, or otherwise affixed to the strap portion 102.

The protrusions 110 of the head portion 106 are disposed within the passage 108 to directly engage and support the strap portion 102, which permits the locking ridges 123 to engage the locking pawl 112 to retain the strap portion 102 in the passage 108. Further, the protrusions 110 are disposed to provide a channel 134 that permits the passage of cushioning material 132 between the protrusions 110. Additionally, the locking pawl 112 may include a plurality of retention portions 116 that provide a second channel 136 that permits the passage of cushioning material 130 between the protrusions 110.

Because of channels 134 and 136, the cushioning materials 130 and 132 do not impede insertion of the strap portion 102 into the passage 108 of the head portion 106. Further, the harder material of the locking ridges 123 and the second surface 120 of the strap portion 102 are disposed to directly engage the protrusions 110 and locking pawl 112 of the head portion 106 to provide secure retention of the strap portion 102 within the head portion 106.

Figure 5:
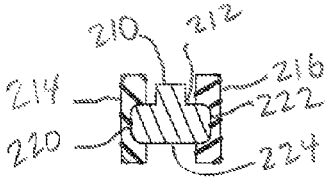
FIG. 5 is a cross sectional view of the flexible strap fastener along line 5-5 of FIG. 4.
Figure 4:
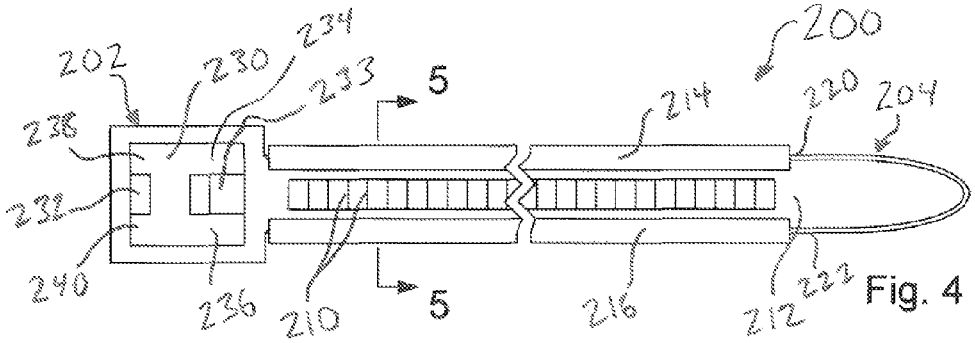
FIG. 4 is a top elevation view of another configuration of a flexible strap fastener.

Referring to FIGS. 4 and 5, a flexible strap fastener 200, similar to flexible strap fastener 100, includes a head portion 202 and a strap portion 204. As shown, a series of locking ridges 210 are disposed on a first surface 212 of the strap portion 204.

Cushioning materials 214 and 216 are disposed adjacent to and extend to a height greater than the locking ridges 210 on the first surface 212. The cushioning materials 214 and 216 are also disposed on respective side surfaces 220 and 222 and portions of the second surface 224. More specifically, the cushioning materials 214 and 216 are disposed to respectively cover a portion of all surfaces 212, 220, 222, and 224 of the strap portion 204.

As shown, the head portion 202 includes a passage 230 having a protrusion 232 and a locking pawl 233 disposed for engagement with the locking ridges 210 of the strap portion 204. The locking pawl 233 may be disposed within the passage 230 of the head portion 202 to provide a first channel 234 and a second channel 236 that respectively permit the cushioning materials 214 and 216 to pass on either side of the locking pawl 233 when the strap portion 204 is inserted into the passage of the head portion 202.

The protrusion 232 is disposed opposite of the locking pawl 233 to support engagement of the locking pawl 233 with the locking ridges 210. Similarly, the protrusion 232 may be disposed to provide a third channel 238 and a fourth channel 240 that respectively permit the cushioning materials 214 and 216 to pass on either side of the protrusion 232.

In this configuration, the cushioning materials 214 and 216 may dampen mechanical vibration and other external forces that affect the relationship between the flexible strap, a secured article, and adjacent equipment. Additionally, the cushioning materials 214 and 216 may prevent unwanted repositioning and wear due to rubbing contact between the one or more secured articles, the flexible strap, and securements. Further, even if the flexible strap fastener 200 rolls over on itself, a secured article may still be directly cushioned and supported by the cushioning materials 214 and 216 of the flexible strap fastener 200.

Figure 6:
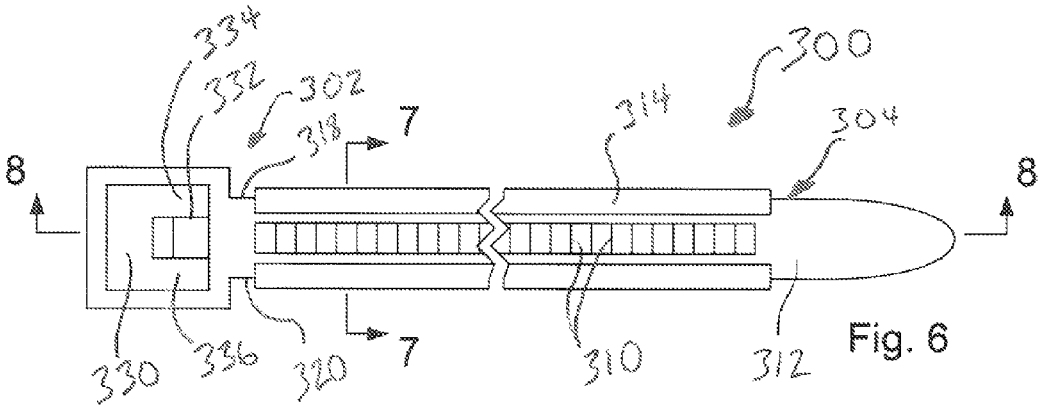
FIG. 6 is a top elevation view of yet another configuration of a flexible strap fastener.
Figure 7:
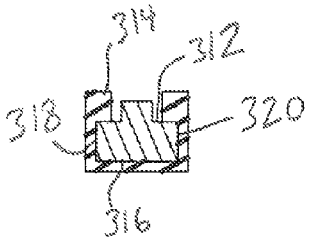
FIG. 7 is a cross sectional view of the flexible strap fastener along line 7-7 of FIG. 6.

Referring to FIGS. 6 and 7, a flexible strap fastener 300, similar to flexible strap fasteners 100 and 200, includes a head portion 302 and a strap portion 304 having a series of locking ridges 310 disposed on a first surface 312 of the strap portion 304. Cushioning material 314 is disposed on both sides of the locking ridges 310 on the first surface 312. The cushioning material 314 also covers a portion of a second surface 316, a first side surface 318, and a second side surface 320.

As shown, the head portion 302 includes a passage 330 having a locking pawl 332 disposed for engagement with the locking ridges 310 of the strap portion 304. The locking pawl 332 may be disposed within the head portion 302 to provide a first channel 334 and a second channel 336 that respectively permit the cushioning material 314 to pass around the locking pawl 332 when the strap portion 304 is inserted into the passage of the head portion 302.

Figure 8:
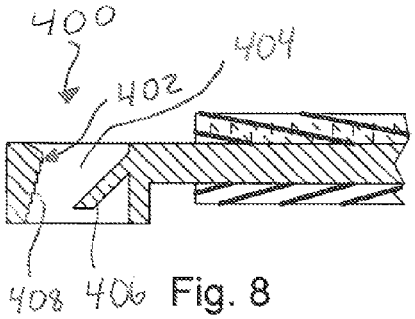
FIG. 8 is a partial cross sectional view of an optional configuration of a head portion for use with the flexible strap fastener of FIG. 6 and taken along lines 8-8.

Referring to FIG. 8, a partial cross sectional view illustrates an optional configuration of a head portion 400 for use with the flexible strap fastener 300 shown in FIG. 6. As shown, a protrusion 402 of the passage 404 disposed opposite a locking pawl 406 may include a plurality of retention features 408. The retention features 408 may engage the cushioning material 314 on the second surface 316 of the strap portion 304 to assist the locking pawl 406 in preventing the withdrawal of the strap portion 304 from the passage 404.

Industrial Applicability

In use, the flexible strap fastener is formed into a loop surrounding an article to be secured. The article could compose a single component such as a hydraulic hose, to be attached to an associated securement, or a plurality of individual elements such as electrical cables to be retained together in a compact bundle and secured to the frame of a machine.

To secure the one or more articles, the strap portion is inserted into the passage of the head portion. The strap portion is pulled through the passage until the cushioning material of the first surface is held against an outer perimeter of the one or more articles and the locking pawl engages the locking ridges to secure the flexible strap fastener in place.

When the strap portion is inserted between locking pawl and protrusions or wall, the locking pawl is deformed creating a restoring force at the live hinge, which urges the locking pawl toward protrusions or wall. The resilience of the living hinge urges the locking pawl into engagement with the locking ridges to prevent withdrawal of the strap portion from the passage of the head portion.

The cushioning material of the strap portion deforms upon contact with the one or more articles and/or securement and fills the interstices between the one or more articles and/or securement. The cushioning material may provide cushioned contact and dampening with the one or more articles and/or securement, and the deformed pattern may also provide a positive engagement of the strap portion with the perimeter of the one or more articles and/or securement to resist movement of the flexible strap fastener relative to the one or more articles and/or securement.

In one configuration, the flexible strap fasteners of this disclosure may be made of a high durometer rubber and the cushioning material may be made of a low durometer rubber. More specifically, the main body of the flexible strap fasteners may be made of the same base polymer as the cushioning material except that the main body is compounded for higher strength and lower ductility. Consequently, when the main body and the cushioning material are formed, the two layers may be cross-linked to provide a flexible strap fastener that resists delamination between the main body and the cushioning material. Additionally, the main body and the cushioning material may be cured together to speed manufacturing time. Alternatively, the main body may be formed and the cushioning material overmolded onto the main body in a two-shot or insert injection molding process.

What is claimed is:

1. A flexible strap fastener comprising:

a head portion including a passage and a locking pawl disposed within the passage;

a strap portion connected to the head portion, and extending longitudinally to a free end of the flexible strap fastener opposite the head portion and formed from a first material, the strap portion including a first surface and a first longitudinal row of locking ridges disposed on the first surface; and cushioning material formed from a second material that is different than the first material, the cushioning material being connected to the strap portion and disposed adjacent and longitudinally along the first longitudinal row of locking fidges on the first surface with the locking ridges longitudinally along the cushioning material being engageable by the locking pawl.

2. The flexible strap fastener of claim 1, wherein a second longitudinal row of locking ridges is disposed adjacent and the longitudinally along the first longitudinal row of locking ridges with the first and second longitudinal rows defining a gap therebetween, wherein the cushioning material is disposed in the gap.

3. The flexible strap fastener of claim 1, wherein the cushioning material has a height that is greater than the height of the first longitudinal row of locking ridges.

4. The flexible strap fastener of claim 1, wherein the cushioning material is disposed to cover a portion of the first surface, a second surface, a first side surface, and a second side surface of the strap portion.

5. A flexible strap fastener comprising:

a head portion including a passage and a locking pawl disposed within the passage;

a strap portion connected to the head portion and formed from a first material, the strap portion including a first surface and a plurality of locking ridges disposed on the first surface; and cushioning material formed from a second material that is different than the first material, the cushioning material being connected to the strap portion and disposed adjacent the plurality of locking ridges on the first surface, wherein the head portion further includes a channel shaped and disposed to permit passage of the cushioning material through the passage of the head portion.

6. The flexible strap fastener as claimed in claim 5, wherein the first material has a first hardness, and the second-material has a second hardness that is less than the first hardness of the first material.

7. The flexible strap fastener as claimed in claim 6, wherein the first material and the second material are different materials.

8. The flexible strap fastener as claimed in claim 6, wherein the first material is a high durometer rubber and the second material is a low durometer rubber.

9. The flexible strap fastener as claimed in claim 5, wherein the first material has a first coefficient of friction, and the second material has a second coefficient of friction that is greater than the first coefficient of friction of the first material.

10. The flexible strap fastener as claimed in claim 9, wherein the first material and the second material are different materials.

11. A flexible strap fastener comprising:

a head portion including a passage, a locking pawl disposed within the passage, and a protrusion disposed opposite the locking pawl about the passage;

a strap portion connected to the head portion and formed from a first material, the strap portion including a first surface and a plurality of locking ridges disposed on the first surface; and cushioning material formed from a second material that is different than the first material, the cushioning material being connected to the strap portion and disposed adjacent the plurality of locking ridges on the first surface.

12. The flexible strap fastener of claim 11, wherein the protrusion includes retention features.

13. The flexible strap fastener of claim 11, wherein the protrusion is disposed to form one or more channels shaped to permit passage of the cushioning material through the passage of the head portion.

14. The flexible strap fastener of claim 11, wherein the head portion further includes a second protrusion, wherein the protrusion and the second protrusion form a channel between the protrusion and the second protrusion.

15. A flexible strap fastener comprising:

a head portion including a passage and a locking pawl disposed within the passage;

a strap portion connected to the head portion and formed from a first material, the strap portion including a first surface and a plurality of locking ridges disposed on the first surface; and cushioning material formed from a second material that is different than the first material, the cushioning material being connected to the strap portion and disposed adjacent the plurality of locking ridges on the first surface, wherein the cushioning material extends longer than the plurality of locking ridges over the first surface.

16. The flexible strap fastener as claimed in claim 15 wherein said strap portion and head portion define a strap fastener body and said cushioning material is a strip of soft thermoplastic elastomer overmolded onto said strap fastener body.

17. A flexible strap fastener comprising:

a head portion including a passage and a locking pawl disposed within the passage;

a strap portion connected to the head portion, the strap portion including a first surface and a plurality of locking ridges disposed on the first surface; and cushioning material disposed adjacent the plurality of locking ridges on the first surface, wherein the strap portion comprises a main body of the flexible strap fastener, wherein the cushioning material extends longer than the plurality of locking ridges over the first surface and wherein said cushioning material is a strip of soft thermoplastic elastomer secured to said main body with an adhesive.

* * * * *